United States Patent [19]

DeMatteo, Jr.

[11] 4,152,306

[45] May 1, 1979

[54] WINDSHIELD CLEANING SOLVENT

[75] Inventor: Louis DeMatteo, Jr., Brooklyn, N.Y.

[73] Assignee: LDMJ Limited, Brooklyn, N.Y.

[21] Appl. No.: 895,354

[22] Filed: Apr. 11, 1978

Related U.S. Application Data

[63] Continuation-in-part of Ser. No. 661,542, Feb. 26, 1976, abandoned.

[51] Int. Cl.[2] ..... C11D 3/065

[52] U.S. Cl. ..... 252/539; 252/70; 252/135; 252/139; 252/DIG. 10; 252/DIG. 14; 106/13

[58] Field of Search ..... 252/135, 139, 539, 70, 252/DIG. 10, DIG. 14; 106/13

[56] References Cited

U.S. PATENT DOCUMENTS

| | | | |
|---|---|---|---|
| 2,877,185 | 3/1959 | Krumrei | 252/529 |
| 3,101,324 | 8/1963 | Wixon | 253/139 |
| 3,173,876 | 3/1965 | Zofrist | 252/525 |
| 3,231,504 | 1/1966 | Marion | 252/539 |
| 3,245,912 | 4/1966 | White | 252/70 |
| 3,463,735 | 8/1969 | Stonebraker | 252/523 |
| 3,591,509 | 7/1971 | Parks | 252/539 |
| 3,634,268 | 1/1972 | Karg | 252/529 |
| 3,696,042 | 10/1972 | Wright | 252/153 |
| 3,835,070 | 9/1974 | Beck | 252/526 |
| 3,887,497 | 6/1975 | Uloild | 252/526 |

*Primary Examiner*—Mayer Weinblatt
*Attorney, Agent, or Firm*—Otto S. Kauder

[57] ABSTRACT

A windshield cleaning solvent composition is provided, consisting essentially of water, alkali metal phosphate having in a 1% aqueous solution a pH of at least 10, sodium alkylbenzenesulfonate having 1 to 3 alkyl groups with a total of 1 to 17 carbon atoms in the alkyl groups, and alkoxyalkanol in certain proportions.

13 Claims, No Drawings

WINDSHIELD CLEANING SOLVENT

BACKGROUND OF THE INVENTION

Cross-Reference to Related Application

This application is a continuation in part of my copending application Ser. No. 661,542 filed Feb. 26, 1976 and now abandoned.

FIELD OF THE INVENTION AND PRIOR ART

This invention relates to a solvent composition that can be applied to provide a clean, clear windshield for drivers of any vehicle that employs a windshield wiper blade, when it is raining for example automobiles, trucks, buses, trains, boats, planes, etc.

It is common knowledge among drivers of these vehicles that when it starts to rain, and the windshield wipers are turned on, as the blade or blades, move across the windshield in a back and forth motion, a continuous streak (the width of the blade) tails the blade, back and forth, back and forth, hampering the drivers's vision.

I call this smear "a grease streak" due to such "atmospheric conditions" as worn engines that burn oil in cars, trucks, buses, etc., diesel trucks that burn oil, oil burners in homes, factories, office buildings, etc. All these dirt producing outlets fill the air, and settle on windshields of these vehicles, coating the windshields and wiper blades with a greasy substance.

When it starts to rain the water is not enough to remove this grease streak, which therefore remains on the window, streaking back and forth, creating danger to drivers of these vehicles because of poor visibility.

Windshields become pitted with age because of the wind blowing millions of tiny dust particles against it, and it is these pitted areas in the windshield that house the grease from the atmosphere, creating this continuous smear.

Although there are inventions on the market today that clean windshields by chemically treated cloths or one whereby chemicals are applied to the windshield and after drying keeps the rain off the windshield, my invention works in a completely different way. The cleaning solvent composition of my invention is sprayed on the windshield while it is raining for the sole purpose of dissolving the grease and the wiper blades then have the opportunity to sweep the grease off leaving the windshield crystal clear.

The patent literature contains many disclosures of liquid cleaning compositions, including compositions stated to be useful for cleaning glass and other hard surfaces. Thus, J. C. Zobrist in U.S. Pat. No. 3,173,876 of Mar. 16, 1965 disclosed cleaning compositions for use on the surface of glass, tile, and other vitreous or highly reflective surfaces which may be applied either by transfer from a saturated applicator or by spraying, containing aqueous solutions of ethylenediamine, the amine being present in amounts of from 0.2% to 12%. Zobrist points out that compared to ethylenediamine, soap and detergent compositions from the standpoint of cleaning action leave much to be desired because they invariably result in a streaked finish.

W. G. White in U.S. Pat. No. 3,245,912 of Apr. 12, 1966 disclosed a windshield de-icing composition designed for easy application, rapid ice melting, balanced volatility to provide residual de-icing activity to inhibit re-icing, and freedom from significant corrosivity or detrimental effect of the composition to metal and automotive finish. White's composition is a mixture of (A) a water-soluble monohydric alcohol component of which at least 50% is isopropanol, and (B) a water soluble saturated aliphatic dihydric alcohol component comprising at least one of ethylene glycol, 1,2-propylene glycol, dipropylene glycol, and dihydric ethers of the general formula $$HO-(CH_2-CH_2-O-)_n-CH_2-CH_2-CH_2OH$$

where n is an integer in the range of 1 to 5, and including 0.25% to 3% by weight of (C) at least one soluble alkylphenoxypolyethanoxyethanol having from 7 to 12 carbon atoms in the alkyl substituent joined to the phenoxy group and about 8 to 20 moles of condensed ethylene oxide per mole of alkylphenol. In White's composition, the proportion of (B) is from 5 to 30% and the proportion of (A) plus any water present is at least 67%. White states that ionic salts fail to meet several of the above qualifications for an effective product, but mentions nothing of any cleaning effectiveness of his composition.

M. E. Stonebraker in U.S. Pat. No. 3,463,735 of August 26, 1969 disclosed that a negative interaction takes place between an alcohol-glycol solvent combination and an aqueous anionic or non-ionic surfactant when combined in a glass cleaning composition, resulting in a loss of effectiveness. To remedy this loss of effectiveness, Stonebraker disclosed the addition of a polyphosphate or molecularly dehydrated phosphate, preferably in combination with a small quantity of ammonia, provided the aqueous component is substantially free from calcium and magnesium ions, i.e. made of soft water. The amount of phosphate is regulated at 0.005 to 0.5% by weight and preferably not in excess of 0.2% in order to maintain the level of solids in the composition as low as possible if a visible film of residual material after cleaning is to be avoided.

L. R. Parks et al in U.S. Pat. No. 3,591,509 of July 6, 1971 disclosed a liquid detergent hard surface cleaning composition consisting essentially of an aqueous medium containing a synthetic detergent; a builder or combination of builders; an organic solvent or mixture or organic solvents which are sufficiently hydrophobic to dissolve oily soils e.g. grease, and carboxymethylcelluloses having a high degree of substitution and degree of polymerization. Parks' composition is said to clean hard surfaces when used in a no-rinse method without leaving an objectionable residual film.

S. A. Wright in U.S. Pat. No. 3,696,042 of Oct. 3, 1972 disclosed a windshield washer solution useful in a windshield washer system of automobiles that at the same time conditions the rubber windshield wiper blades so as to renew and lengthen their useful life. Wright's composition comprises a low alcohol cleaning agent and a minor proportion of diethylene glycol. Other components advantageously included are ammonia and a surfactant, preferably a non-ionic surfactant known to lose effectiveness or activity less quickly than other types of surfactants upon dilution with water, such as a non-ionic surfactant of the ethoxylated nonylphenol type.

C. A. Beck in U.S. Pat. No. 3,835,070 of Sept. 10, 1974 disclosed predominantly aqueous hard surface cleaner having an improved ability to remove stubborn organic soils. Beck's cleaner consists essentially of (a) from 0.5 to 10 percent by weight methylene chloride;

(b) from 0.5 to 5 percent of a $C_1$–$C_4$ monoalkyl ether of ethylene glycol;

(c) from 0.5 to 5 percent of a $C_1$–$C_4$ alcohol;

(d) from 0.5 to 5 percent of a water-soluble, alkaline, inorganic builder, (e) from 0.5 to 10 percent of an anionic surfactant selected from the group consisting of the free acid form or alkali metal, ammonium and amine salts of a compound having a formula selected from the group consisting of

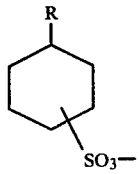

and R—$(OC_1H_4)_a$—O—$SO_1$— wherein R is a $C_{10}$–$C_{14}$ alkyl and n is an integer from 3–18 and, (f) the balance water.

Beck characterizes as not completely effective for the intended purpose conventional cleaners that contain on the order of 80 percent water and depend for their effectiveness on a combination of the cleaning ability of inorganic alkaline detergent builders, the solvency power of certain organic liquids incorporated in minor amounts, and the detergency of the (generally) anionic surfactants included.

There are also numerous disclosures of liquid detergent and cleansing compositions not specifically directed to glass or automotive cleaning use, among which U.S. Pat. Nos. 2,877,185, 3,101,324, 3,231,504, 3,634,268, and 3,887,497 can be cited. Essential to the inventive concept of each of these patents is the use of one or more special purpose ingredients such as alkali metal alkyl glyceryl ether sulfonates, sodium silicate, higher fatty acid alkylolamide, alkali metal higher alkyl polyethoxamer sulfates, urea, and amine salts of alkylbenzenesulfonic acids, as well as the absence of certain ingredients essential according to the present invention.

In a 1975 publication titled "Monsanto Phosphates for Industry," Monsanto Co. summarized physical and chemical properties of sodium and potassium salts of orthophosphoric acid and polymeric or condensed phosphoric acids, and provided a number of recipes for compounded detergents and cleaners. There are, however, no windshield or glass cleaning recipes included in this publication.

SUMMARY OF THE INVENTION

In accordance with this invention, I provide a windshield cleaning solvent composition that can be installed in the windshield washer liquid receptacle and dispensed as required by pushing the electric washer button, where the vehicle is suitably equipped, or dispensed by spraying directly on the windshield from a hand spray bottle where the vehicle does not have an automatic spray device.

My composition can be used in all weather conditions and is non-aggressive to the windshield washer liquid receptacle, connecting lines, and spray device as well as to painted or chrome plated surfaces on the vehicle.

My composition consists essentially of water, 400 to 960 parts by weight; alkali metal phosphate having in a 1% aqueous solution a pH of at least 10, 3 to 50 parts by weight; sodium alkylbenzenesulfonate having 1 to 17 carbon atoms disposed in one to three alkyl group substituents on the benzene ring, 1 to 50 parts by weignt; and at least one alkoxyalkanol having 3 to 7 carbon atoms, 3 to 50 parts by weight. To lower the freezing point of the composition as required for winter use, up to three fourths of the water can be replaced by a lower alcohol having 1 to 2 carbon atoms, such as methanol or ethanol. Ethylene glycol while a satisfactory antifreeze diminishes the effectiveness of my composition and should not be used.

DESCRIPTION OF THE PREFERRED EMBODIMENTS

Water, alone or mixed with enough lower alcohol to prevent freezing during winter use, is the largest constituent of my composition and represents at least 70% by weight thereof. It is a feature of my invention that softened or otherwise specially purified water is not required, and water as supplied by any public water supply system can be used.

The alkali metal phosphate that can be used is a phosphate having in a 1% aqueous solution a pH of at least 10. Such phosphates include trisodium phosphate, tripotassium phosphate, disodium monopotassium phosphate, tetra-sodium pyrophosphate, tetra-potassium pyrophosphate, disodium-dipotassium pyrophosphate, sodium tripolyphosphate, potassium tripolyphosphate, and mixtures thereof. Particularly preferred are tetrapotassium pyrophosphate alone or combined with trisodium phosphate. When alcohol anti-freeze is included in the composition the alkali metal phosphate is preferably a potassium phosphate.

The sodium alkylbenzenesulfonates used according to this invention include well known and readily available commercial products familiar under a variety of trade names such as Sulframin and Ultrawet and abbreviations, such as "LAS active," or "SXS sulfonate," or "hydrotrope." Sulframin$^R$ 1250 Slurry, for example, is described in Bulletin 971 issued in November 1975 by Witco Chemical Organics Division (277 Park Avenue, New York, N.Y. 10017) as "the sodium salt of a linear alkylaryl sulfonic acid with an average side chain of slightly over 11 carbon atoms. Sulframin 1250 Slurry detergent contains no hydrotrope." Properties given included the formula

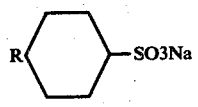

as well as Active Content 50%, Water 47.9% and Physical Form—Paste. Similarly, Bulletin 965 issued January 1975 by Witco describes Sulframin 1240 Slurry detergent by the formula

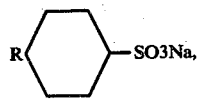

the identification "the sodium salt of a linear alkyl aryl sulfonic acid with an average side chain of slightly over eleven carbon atoms" and the properties Physical Form—Liquid, Active Content 40% and Water 58.0%. Since the absence of hydrotrope is specifically indicated for Sulframin 1250, the presence of hydrotrope (i.e. sodium xylenesulfonate or similar compound) in Sulframin 1240 Slurry detergent is implied. Further confirmation that Sulframin trademark with a number is easily decoded into a chemical identification is found in the review by C. E. Stevens in Kirk-Othmer "Encyclopedia of Chemical Technology," second edition (J. Wiley—Interscience, New York 1969) volume 19 page 518 where Sulframin 90 Flake is indicated to be 91% active sodiumalkylbenzenesulfonate and Sulframin 1298 is indicated to be 98% active dodecylbenzenesulfonic acid. Ultrawet$^R$ K (trademark of Arco Chemical Co.) is identified in U.S. Government publication (Department of Health, Education, and Welfare "Toxic Substances List" page 795 of 1974 edition) as Benzenesulfonic acid, dodecyl, sodium salt, and LAS, sodium salt at page 451 of the same publication as Benezenesulfonic acid, linear alkyl, sodium salt. The use of "hydrotrope" to indicate lower alkylbenzenesulfonate salts such as sodium toluenesulfonate, sodium xylenesulfonate, sodium ethylbenzenesulfonate and similar salts is explained in the Stevens review article already referred to at page 580.

In the sodium alkylbenzenesulfonate used according to this invention, the alkyl group can be for example methyl, ethyl, isopropyl, n-propyl, n-butyl, isobutyl, s-butyl, t-butyl, t-amyl, n-hexyl, 2-hexyl, 3-hexyl, 2,3-dimethyl-2-butyl, 2-ethylhexyl, t-octyl, 2-octyl, 3-octyl, 4-octyl, 2-nonyl, mixed nonyl from propylene trimer, n-decyl, linear decyl, mixed dodecyl from propylene tetramer, linear dodecyl, linear tridecyl, linear tetradecyl, mixed pentadecyl from propylene pentamer, 1-hexadecyl, 2-hexadecyl, and linear hexadecyl. There can be from 1 to 3 alkyl groups having an aggregate carbon content not greater than 17 carbon atoms.

Accordingly, sodium alkylbenzenesulfonates that can be used, alone or in combination, include sodium toluenesulfonate, sodium xylenesulfonate, sodium ethylbenzenesulfonate, sodium trimethylbenzenesulfonate, sodium t-butylbenzenesulfonate, sodium t-octylbenzenesulfonate, sodium nonylbenzenesulfonate, sodium decylbenzenesulfonate, sodium nonyltoluenesulfonate, sodium octylxylenesulfonate, sodium ethyldodecylbenzenesulfonate, sodium tetradecylbenzenesulfonate and sodium hexadecyltoluenesulfonate. Preferred are the commercially available and economical mixtures of sodium alkylbenzenesulfonate isomers and homologs identified by an average chain length alkyl group having 11 to 13 carbon atoms and combinations thereof with "hydrotrope" i.e. sodium xylenesulfonate; for explanation of the nature and preparation of such sodium alkylbenzenesulfonates see the Stevens review article at pages 516–18. Preferred use concentrations are from 0.1 to 2% by weight of the windshield cleaning composition.

The alkoxalkanol used in the windshield cleaning composition according to my invention can be any one or more of 2-methoxyethanol, 2-methoxy-1-propanol, 1-methoxy-2-propanol, 2-ethoxyethanol, 2-isopropoxyethanol, 1-ethoxy-2-propanol, 2-n-butoxyethanol, 2-isobutoxyethanol, 1-isopropoxy-2-propanol, 1-n-butoxy-2-propanol, 1-isobutoxy-2-propanol and 2-n-butoxy-1-propanol. The preferred alkoxyalkanol is 2-butoxyethanol. The preferred use concentrations of the alkoxyalkanol are from 0.5 to 5% by weight of the windshield cleaning composition.

My windshield cleaning composition is readily prepared from the ingredients thereof by conventional procedures. The solid ingredients are combined with the water and alkoxyalkanol and lower alcohol when required in any convenient order, suitably with agitation and/or gentle warming to about 160° F. to help speed dissolution.

When solution is achieved, the composition is ready for packaging, sale, or use and storage stable for long periods of time. Packaging is suitably in any convenient size glass, plastic, or metal container with the exception of aluminum which should be avoided because of the alkalinity of the composition.

In the compositions that follow, ingredients are mixed as stated below, and in order as shown, for summer and winter uses.

It also should be understood that the proportions may be varied within the ranges shown without departing from the strength of the product, for the job it was formulated to do, and again it should also be understood that the ingredients may be compounded in any manner desirable.

Coloring dye (non-vegetable) and/or perfume, may or may not be added, but in either case it is irrelevant to the basic formula.

Although my invention is primarily for windshields, while it is raining, this product is also good if used as an "all purpose cleaner."

EXAMPLE 1

The following ingredients are combined and mixed to provide a uniform stable windshield cleaning mixture for winter and summer uses, removing hazardous wax, oils, grease, and bug smears, also providing approximately 10 degrees below zero protection from freezing.

| | | |
|---|---|---|
| Water | 540 grams | |
| Tetrapotassium pyrophosphate | 20 grams | |
| Sulframin 1240 Slurry (40% active sodium LAS with hydrotrope) | 10 grams | |
| Ultrawet 60 K (60% active sodium dodecylbenzenesulfonate) | 10 grams | |
| Butyl Cellosolve (2-butoxyethanol) | 18 grams | (20 cc) |
| Methanol | 317 grams | (400 cc) |
| Weight total: 915 grams. | Volume total: | 1000 cc |

EXAMPLE 2

| | | |
|---|---|---|
| Water | 920 grams | |
| Tetrapotassium pyrophosphate | 20 grams | |
| Sulframin 1240 Slurry (see above) | 10 grams | |
| Ultrawet 60 K (see above) | 10 grams | |
| Butyl Cellosolve (2-butoxyethanol) | 18 grams | (20 cc) |
| Trisodium phosphate | 20 grams | |
| Weight total: 998 grams. | Volume total: | 1000 cc |

EXAMPLE 3

The following ingredients are combined and mixed to provide a "double-strength concentrate" suitable for shipment over long distances and convenient dilution at the point of use by mixing with an equal volume of water.

| | | |
|---|---|---|
| Water | 125 grams | |
| Tetrapotassiumpyrophosphate | 22 grams | |
| Santomerse D. (Monsanto Co., sodium decylbenzenesulfonate dry) | 18 grams | |
| Ethyl Cellosolve (2-ethoxyethanol) | 24 grams | (25 cc) |
| Methanol | 330 grams | (416 cc) |
| Weight total; 519 grams | Volume total: | 605 cc |

EXAMPLES 4 TO 11

Additional windshield cleaning compositions according to this invention are formulated from the following ingredients. All parts are by weight.

| Example | 4 | 5 | 6 | 7 | 8 | 9 | 10 | 11 |
|---|---|---|---|---|---|---|---|---|
| Water | 939 | 940 | 941 | 944 | 933 | 943 | 930 | 597 |
| Tripotassium phosphate | 13 | — | — | — | — | — | 23 | — |
| Potassium tripolyphosphate | — | 31 | — | — | — | — | — | — |
| Sodium tripolyphosphate | — | — | 22 | — | 29 | — | — | — |
| Tetrasodium pyrophosphate | — | — | — | 33 | — | 25 | 17 | — |
| Trisodium phosphate | 15 | — | — | — | 9 | — | — | — |
| Tetrapotassium pyrophosphate | — | — | — | — | — | — | — | 16 |
| Sodium xylenesulfonate | 2 | — | — | — | — | — | 4 | — |
| Sodium linear tridecylbenzenesulfonate | 8 | 12 | — | 9 | — | — | 10 | — |
| Sodium linear dodecylbenzenesulfonate | — | — | 11 | — | 8 | 13 | — | 7 |
| 2-Ethoxyethanol | — | — | 26 | 14 | — | — | — | — |
| 1-Methoxy-2-propanol | 23 | — | — | — | — | 19 | — | — |
| 2-Isobutoxyethanol | — | 17 | — | — | 21 | — | 16 | — |
| 2 Methoxyethanol | — | — | — | — | — | — | — | 20 |
| Denatured ethyl alcohol | — | — | — | — | — | — | — | 360 |
| Winter protected | no | no | no | no | no | no | no | yes |

While the invention has been described in specific examples and embodiments, modifications within the scope of the appended claims will be readily apparent to the skilled practitioner.

I claim:

1. A windshield cleaning solvent composition consisting essentially of 400 to 960 parts by weight of water, 3 to 50 parts by weight of at least one alkali metal phosphate having a pH in 1% aqueous solution of at least 10, 1 to 50 parts by weight of at least one sodium alkylbenzenesulfonate having a total of 1 to 17 carbon atoms linked to the benzene ring in 1 to 3 alkyl groups, and 3 to 50 parts by weight of at least one alkoxyalkanol having 3 to 7 carbon atoms.

2. A windshield cleaning solvent composition according to claim 1 in which the alkali metal phosphate is tetrasodium pyrophosphate.

3. A windshield cleaning solvent composition according to claim 1 in which the alkali metal phosphate is sodium tripolyphosphate.

4. A windshield cleaning solvent composition according to claim 1 in which the alkali metal phosphate is a combination of tetrapotassium pyrophosphate and trisodiumphosphate.

5. A windshield cleaning solvent composition according to claim 1 in which the sodium alkylbenzenesulfonate is sodium dodecylbenzenesulfonate.

6. A windshield cleaning solvent composition according to claim 1 in which the sodium alkylbenzenesulfonate is a combination of sodium dodecylbenzenesulfonate and sodium xylenesulfonate.

7. A windshield cleaning solvent composition according to claim 1 in which the alkoxyalkanol is 2-n-butoxyethanol.

8. A windshield cleaning solvent composition according to claim 1 in which the proportion of alkali metal phosphate is 1.6 to 4.3% by weight.

9. A windshield cleaning solvent composition according to claim 1 in which the proportion of sodium alkylbenzenesulfonate is 0.1 to 2% by weight.

10. A windshield cleaning solvent composition according to claim 1 in which the proportion of alkoxyalkanol is 0.5 to 5% by weight.

11. A windshield cleaning solvent composition according to claim 1 consisting essentially of 540 to 930 parts by weight of water, 16 to 25 parts by weight of tetrapotassium pyrophosphate, 4 to 15 parts by weight of sodium alkylbenzenesulfonate, 10 to 25 parts by weight of 2-butoxyethanol, and 0 to 350 parts by weight of methanol.

12. A windshield cleaning solvent composition according to claim 1 in which the alkali metal phosphate is tetrapotassium pyrophosphate.

13. A windshield cleaning solvent according to claim 2 containing as an additional ingredient an anti-freeze effective amount of methanol.

* * * * *